US009657613B2

(12) United States Patent
Aoyagi

(10) Patent No.: US 9,657,613 B2
(45) Date of Patent: May 23, 2017

(54) ENGINE AND STRADDLE-TYPE VEHICLE EQUIPPED WITH ENGINE

(71) Applicant: YAMAHA HATSUDOKI KABUSHIKI KAISHA, Iwata-shi (JP)

(72) Inventor: Kenji Aoyagi, Iwata (JP)

(73) Assignee: YAMAHA HATSUDOKI KABUSHIKI KAISHA, Iwata-Shi (JP)

( * ) Notice: Subject to any disclaimer, the term of this patent is extended or adjusted under 35 U.S.C. 154(b) by 228 days.

(21) Appl. No.: 14/529,975

(22) Filed: Oct. 31, 2014

(65) Prior Publication Data

US 2015/0122210 A1 May 7, 2015

(30) Foreign Application Priority Data

Nov. 7, 2013 (JP) ..... 2013-231550

(51) Int. Cl.
*F01M 1/06* (2006.01)
*F02F 11/00* (2006.01)
(Continued)

(52) U.S. Cl.
CPC ..... *F01M 9/10* (2013.01); *F01L 1/022* (2013.01); *F01M 9/08* (2013.01); *F01M 9/101* (2013.01);
(Continued)

(58) Field of Classification Search
CPC ..... F02M 9/10; F02M 11/002; F02M 1/002; F01M 9/10; F01M 9/101; F02B 61/02; F02B 3/06
(Continued)

(56) References Cited

U.S. PATENT DOCUMENTS 6,805,083 B2 * 10/2004 Kaczmarek ..... F01L 1/185 123/195 C
6,883,483 B1 * 4/2005 Knudsen ..... F01L 1/146 123/193.5
(Continued)

FOREIGN PATENT DOCUMENTS

DE 3839055 A1 6/1989
DE 102011081973 A1 3/2013
(Continued)

OTHER PUBLICATIONS

Extended European Search Report dated Mar. 10, 2015.

*Primary Examiner* — Carlos A Rivera
*Assistant Examiner* — Syed O Hasan
(74) *Attorney, Agent, or Firm* — Rabin & Berdo, P.C.

(57) ABSTRACT

An engine, including a crankcase, a cylinder body extending upward from the crankcase, a cylinder head coupled to an upper portion of the cylinder body, a cylinder head cover coupled to an upper portion of the cylinder head, and a gasket disposed between the cylinder head and the cylinder head cover. The gasket includes a projection that projects along directions from an inner wall of the cylinder head and from the cylinder head cover toward a camshaft. The projection is located in a cam chain chamber, which is formed in the engine along the cylinder body, the cylinder head and the cylinder head cover, and a cam chamber formed in the engine along the cylinder head and the cylinder head cover. The projection has an oil supply portion disposed in the cam chain chamber and above a cam chain guide guiding a cam chain.

15 Claims, 13 Drawing Sheets

(51) Int. Cl.

| | |
|---|---|
| ***F01M 9/10*** | (2006.01) |
| ***F02M 25/00*** | (2006.01) |
| ***F02B 61/02*** | (2006.01) |
| ***F02F 7/00*** | (2006.01) |
| ***F01L 1/02*** | (2006.01) |
| ***F01M 9/08*** | (2006.01) |

(52) U.S. Cl.
CPC ..... *F02B 61/02* (2013.01); *F02F 7/006* (2013.01); *F02F 11/002* (2013.01)

(58) Field of Classification Search
USPC ..... 277/591; 123/93.3, 193.5, 90.4–90.39, 123/196 R, 195 C, 198 E
See application file for complete search history.

(56) References Cited

U.S. PATENT DOCUMENTS

| | | | | |
|---|---|---|---|---|
| 2006/0065218 | A1* | 3/2006 | Gokan | F01M 5/007 123/41.82 R |
| 2007/0240671 | A1* | 10/2007 | Imazato | F01L 1/053 123/193.5 |

FOREIGN PATENT DOCUMENTS

| | | | |
|---|---|---|---|
| JP | 63-040510 | U | 3/1988 |
| JP | S64-3764 | Y2 | 2/1989 |
| JP | 2000-283294 | A | 10/2000 |

* cited by examiner

ENGINE AND STRADDLE-TYPE VEHICLE EQUIPPED WITH ENGINE

CROSS-REFERENCE TO RELATED APPLICATIONS

This application claims priority to Patent Application No. 2013-231550, filed in Japan on Nov. 7, 2013, the entire contents of which are hereby incorporated by reference.

FIELD OF THE INVENTION

The present invention relates to an engine and a straddle-type vehicle equipped with the engine.

BACKGROUND OF THE INVENTION

Conventionally, oil circulates inside a cylinder head, a cylinder body, a crankcase and so forth in an engine for a motorcycle. The cylinder head is provided with an intake valve and an exhaust valve. A cam chamber formed along a cylinder head and a cylinder head cover is provided with a camshaft equipped with a cam for driving the intake valve and the exhaust valve. The camshaft is connected to a crankshaft through a cam chain. The camshaft rotates driven by the rotation of the crankshaft. The cam chain and a chain guide for guiding the cam chain are disposed in a cam chain chamber formed along the cylinder head cover, the cylinder head and so forth.

A sufficient amount of oil needs to be supplied to the cam chain to effectively transmit a driving force of the crankshaft to the cam shaft, and to prevent the wear of the chain guide that comes in contact with the cam chain. Japanese examined utility model application publication No. 64-3764 discloses an engine having a projection formed on a cylinder head cover above a chain guide. The oil scattered by the rotation of a cam chain comes in contact with the projection, drops onto the chain guide, and is then supplied to the cam chain.

SUMMARY OF THE INVENTION

Problem to be Solved by the Invention

However, the engine disclosed in the Japanese examined utility model application publication No. 64-3764 supplies the cam chain with the oil scattered by the rotation of the cam chain using the projection. As such, it is difficult to supply the cam chain with a sufficient amount of oil. Therefore, in order to increase the amount of oil to be supplied to the cam chain, the amount of oil circulating inside the crankcase and so forth might be increased. In this case, the increase in oil amount leads to an increase in cost. Further, the increase in the amount of oil will increase the amount of oil collecting in the cam chain chamber, thereby possibly causing a mechanical loss due to the stirring of oil by the cam chain.

The present invention was created in consideration of the above problem. Various embodiments of the invention are directed to an engine capable of supplying a cam chain with a sufficiently amount of oil without increasing the amount of oil circulating inside a crankcase and so forth.

Means for Solving the Problem

Embodiments of the present invention make use of the oil scattered from a cam associated with the rotation of a camshaft. The inventor of the present application arrived at an idea of collecting the oil scattering from the cam as a result of various considerations. The inventor found that a sufficiently amount of oil may be supplied to a cam chain without increasing the amount of oil circulating inside a crankcase and so forth, by guiding the collected oil from a cam chamber to a cam chain chamber.

The engine according to one embodiment of the present invention may include: a crankcase; a cylinder body extending upward from the crankcase; a cylinder head coupled to an upper portion of the cylinder body; a cylinder head cover coupled to an upper portion of the cylinder head; a cam chain chamber formed in the engine along the cylinder body, the cylinder head, and the cylinder head cover; a cam chain guide disposed in the cam chain chamber; a cam chamber formed in the engine along the cylinder head and the cylinder head cover; a crankshaft disposed in the crankcase; a cam chain disposed in the cam chain chamber, and configured to interlock with the crankshaft and be guided by the cam chain guide; a camshaft disposed in the cam chamber and configured to interlock with the cam chain; a cam formed on the camshaft and disposed in the cam chamber; and a gasket disposed between the cylinder head and the cylinder head cover, the gasket including a projection formed thereon that projects along a direction from an inner wall of the cylinder head toward the camshaft, and a direction from an inner wall of the cylinder head cover toward the camshaft, is located in the cam chain chamber and the cam chamber, and has an oil supply portion disposed in the cam chain chamber and above the cam chain guide.

In an engine according to one embodiment of the present invention the gasket is provided with the projection projecting from the inner wall of the cylinder head and the inner wall of the cylinder head cover toward the cam shaft. The projection is located in the cam chain chamber and in the cam chamber. As such, a portion of the oil scattering from the cam in the cam chamber is brought into contact with the inner wall of the cylinder head cover and collected on the projection located in the cam chamber. The projection is located in the cam chain chamber and in the cam chamber, and thus the oil collected on the projection in the cam chamber flows from the cam chamber to the cam chain chamber along the surface of the projection. The projection has an oil supply portion disposed in the cam chain chamber and located above the cam chain guide. As such, the oil flowing from the cam chamber to the cam chain chamber along the surface of the projection is supplied from the oil supply portion located above the cam chain guide to the cam chain through the cam chain guide. In this way, a simple structure that the gasket includes the projection having the oil supply portion allows for efficient use of the oil scattering from the cam in the cam chamber. As a result, a sufficient amount of oil is supplied to the cam chain through the cam chain guide without increasing the amount of the oil circulating inside the crankcase and so forth.

In one embodiment of the present invention, the oil supply portion is configured to supply oil flowing on an upper surface of the projection through the cam chain guide to the cam chain.

Thereby, the oil flowing on the upper surface of the projection from the cam chamber to the cam chain chamber is supplied from the oil supply portion to the cam chain through the cam chain guide.

In one embodiment of the present invention, the oil supply portion overlaps the cam chain guide in a plan view of the engine.

Thereby, the oil is supplied from the oil supply portion to the cam chain guide more reliably.

In one embodiment of the present invention, the oil supply portion includes a recess that recedes towards the inner wall of the cylinder head and the inner wall of the cylinder head cover in the plan view of the engine.

The oil flowing along the surface of the projection from the cam chamber to the cam chain chamber is guided to the recess. The recess in the oil supply portion may overlap the cam chain guide in a plan view. As such, the oil is supplied more reliably from the oil supply portion to the cam chain guide.

In one embodiment of the present invention, the oil supply portion includes a protrusion protruding downward.

Thereby, the oil flowing along the surface of the projection is supplied to the cam chain guide along the surface of the protrusion. As such, the oil collected in the cam chamber is supplied to the cam chain more reliably.

In one embodiment of the present invention, a distance between the cam chain and an end of the oil supply portion is shorter than a distance between the end of the oil supply portion and the inner wall of the cylinder head in a plan view of the engine.

As described above, the amount of projection at the end of the oil supply portion is relatively large. Therefore, a larger amount of the oil collected in the cam chamber and the oil scattering from the cam chain is flowed along the surface of the projection. As a result, a larger amount of the oil collected in the cam chamber is supplied to the cam chain through the cam chain guide.

In one embodiment of the present invention, the projection is continuously formed from the cam chamber to the cam chain chamber.

Thereby, the oil scattering from the cam may be effectively guided from the cam chamber to the cam chain chamber.

In one embodiment of the present invention, a distance between the cam shaft in the cam chamber and the inner wall of the cylinder head is shorter than a distance between the cam shaft in the cam chain chamber and the inner wall of the cylinder head in a plan view of the engine, and a distance between a tip end of the projection in the cam chamber and the inner wall of the cylinder head is shorter than a distance between another tip end of the projection in the cam chain chamber and the inner wall of the cylinder head in the plan view of the engine.

The distance between the tip end of the projection in the cam chamber and the inner wall of the cylinder head (hereinafter, defined as the projection amount of the projection) is smaller than the projection amount of the projection in the cam chain chamber, and thus the projection is disposed in a compact form in the cam chamber. Further, the projection amount of the projection in the cam chain chamber is larger compared to a case where the projection amount of the projection in the cam chamber is the same as the projection amount of the projection in the cam chain chamber. Thereby, when oil flows from the cam chamber to the cam chain chamber, the oil hardly drops from the projection. Further, because the projection amount of the projection in the cam chain chamber is relatively large, the distance to the cam chain becomes shorter, and thus oil is easily supplied to the cam chain.

In one embodiment of the present invention, the projection is located lower than an upper end of a rotational locus of the cam.

Thereby, the oil scattering from the cam is collected even more on the projection. As a result, the oil flowing along the surface of the projection from the cam chamber to the cam chain chamber further increases.

In one embodiment of the present invention, the projection is disposed in a position where a portion of the projection faces the cam in a plan view of the engine.

Thereby, the oil scattering from the cam is collected even more on the projection. As a result, the oil flowing along the surface of the projection from the cam chamber to the cam chain chamber further increases.

In one embodiment of the present invention, when the cam makes its closest approach to the projection in a plan view of the engine, a distance between the cam and the projection is shorter than a distance between a portion of the projection to which the cam makes its closest approach and the inner wall of the cylinder head.

As described above, the projection amount of the projection is relatively large. Thereby, the oil scattering from the cam in the cam chamber is collected even more on the projection.

In one embodiment of the present invention, the engine comprises: a support portion configured to support the cam shaft; a valve configured to open and close a combustion chamber; and a lifter disposed on a lateral side and a lower side of the support portion, the lifter being secured to the valve, and being in contact with the cam, wherein the camshaft includes an oil passage through which oil flows to lubricate a contact portion between the lifter and the cam, and the oil is scooped up by the cam and flows to the projection.

Thereby, the configuration described above allows for efficient use of the oil that flows through the camshaft and lubricates the contact portion between the lifter and the cam. As a result, a sufficient amount of oil is supplied to the cam chain through the cam chain guide without increasing the amount of the oil circulating inside the crankcase and so forth.

In one embodiment of the present invention, the projection is formed in a U shape in a plan view of the engine in the cam chain chamber.

As described above, because the projection is formed in a U shape, the projection hardly moves in the vertical direction and may keep a stable condition. Further, the U shape structure facilitates the collection of the oil scattering from the cam chain in the can chain chamber onto the projection.

The straddle-type vehicle according to one embodiment of the present invention is equipped with the engine described above.

The present invention provides a straddle-type vehicle which creates the above-described effects.

In one embodiment of the present invention, the cylinder head is tilted diagonally upward and forward, and the projection is located in front of the camshaft, and is tilted gradually upward as the projection is tilted backward.

Since the cylinder head is tilted, the inner wall of the cylinder head is also tilted, and thus the oil attached to the inner wall of the cylinder head hardly drops downward. Further, the projection is tilted further downward as it goes forward, and thus the oil flowing on the projection hardly drops downward. Thereby, the oil flowing on the projection is supplied from the oil supply portion to the cam chain guide more reliably.

Effect of the Invention

As described above, the present invention provides an engine capable of supplying a sufficient amount of oil to the cam chain without increasing the amount of the oil circulating inside the crankcase and so forth.

MODE FOR CARRYING OUT THE INVENTION

Figure 1:
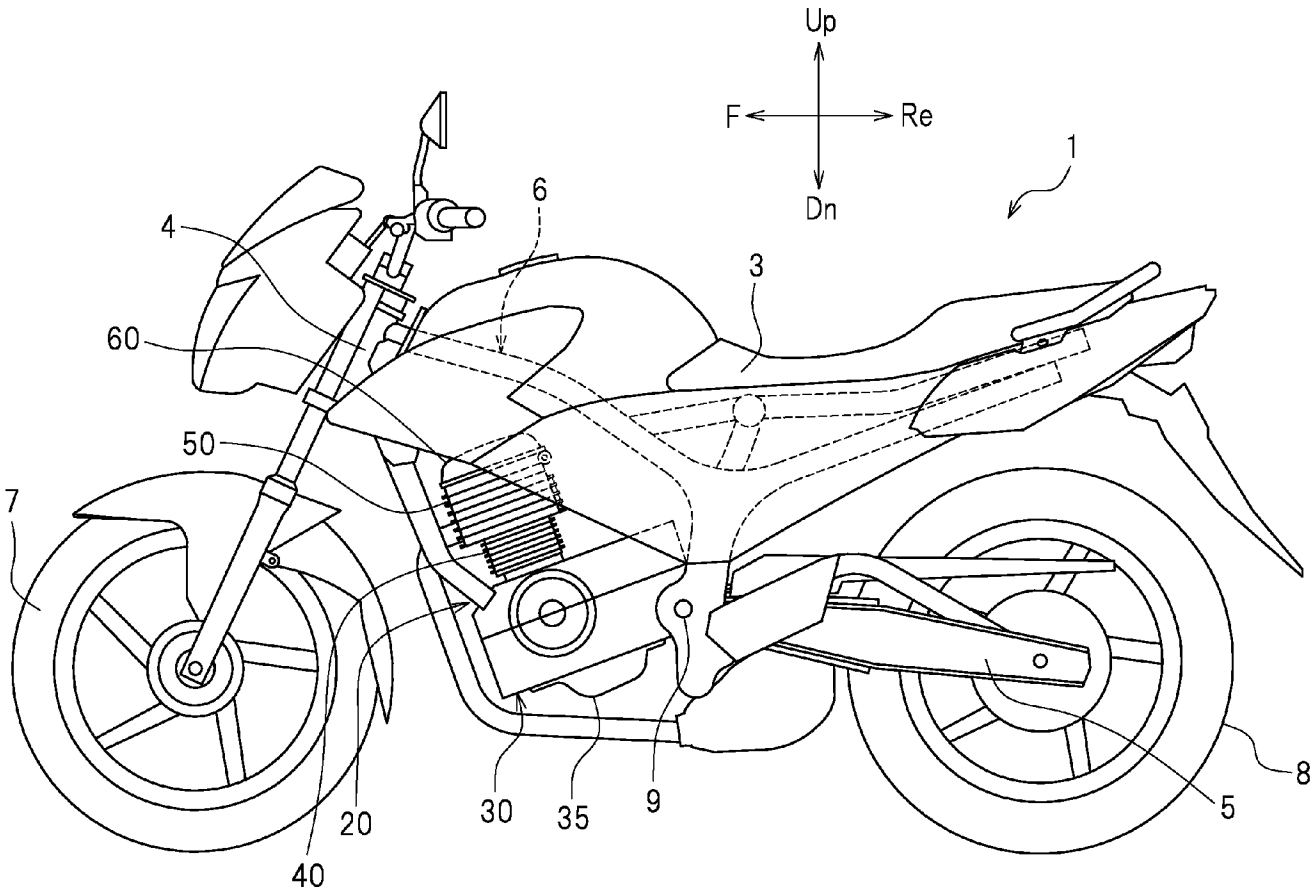
FIG. 1 is a left side view illustrating a motorcycle according to one embodiment of the present invention.

Hereinafter, an embodiment according to the present invention will be described. As shown in FIG. 1, the straddle-type vehicle according to this embodiment may be a motorcycle 1. There is no limitation on the type of the motorcycle 1, and thus the motorcycle 1 may be so-called a scooter type, a moped type, off-road type, on-road type, or the like. Further, the straddle-type vehicle according to the present invention is not limited to a motorcycle. It may also include an ATV (All Terrain Vehicle), a four-wheeled buggy or the like. Additionally, a straddle-type vehicle refers to a vehicle which a rider sits astride.

In the following description, the terms "front", "rear", "left", "right", "up", "down" respectively refer to front, rear, left, right, up, and down as seen from a rider seated on a seat 3 of the motorcycle 1 unless otherwise specified. Up and down respectively refer to up and down in a vertical direction when the motorcycle 1 is stopped on a horizontal plane. The reference numerals F, Re, L, R, Up, Dn added to the drawings respectively represent front, rear, left, right, up, and down. In the description of each components of an engine 20, the above-described respective directions are employed. Therefore, the front, rear, left, right, up, and down of the engine 20 refer to the front, rear, left, right, up, and down seen from a rider with the engine 20 mounted in the motorcycle 1. The vehicle width direction of the engine 20 refers to the vehicle width direction of the motorcycle 1 with the engine 20 mounted in the motorcycle 1.

As shown in FIG. 1, the motorcycle 1 has a head pipe 4, a body frame 6 secured to the head pipe 4, a front wheel 7, and a rear wheel 8. The seat 3 may be disposed behind the head pipe 4. The seat 3 may be supported by the body frame 6. The front end of a rear arm 5 may be connected to the rear portion of the body frame 6 through a pivot shaft 9. The rear wheel 8 may be rotatably supported at the rear end of the rear arm 5.

The motorcycle 1 may be provided with the engine 20 as an internal combustion engine. The engine 20 may be nonswingably supported by the body frame 6. The engine 20 is provided with a crankcase 30, a cylinder body 40, a cylinder head 50, and a cylinder head cover 60. An oil pan 35 for collecting the oil that has circulated inside the engine 20 may be disposed at a lower side of the crankcase 30. The cylinder body 40 extends upward from the front portion of the crankcase 30. Here, the term "upward" is used in a broad sense, and includes both a case where the cylinder body 40 extends vertically upward and a case where the cylinder body 40 is tilted from the vertical direction. In this embodiment, the cylinder body 40 is tilted forward from the vertical direction. However, the cylinder body 40 may extend vertically upward. The cylinder head 50 may be disposed above the cylinder body 40 and coupled to the upper portion of the cylinder body 40. The cylinder head cover 60 may be disposed above the cylinder head 50 and coupled to upper portion of the cylinder head 50. In this embodiment, the cylinder body 40 and the crankcase 30 are separately formed. However, the cylinder body 40 and the crankcase 30 may be integrally formed.

Figure 2:
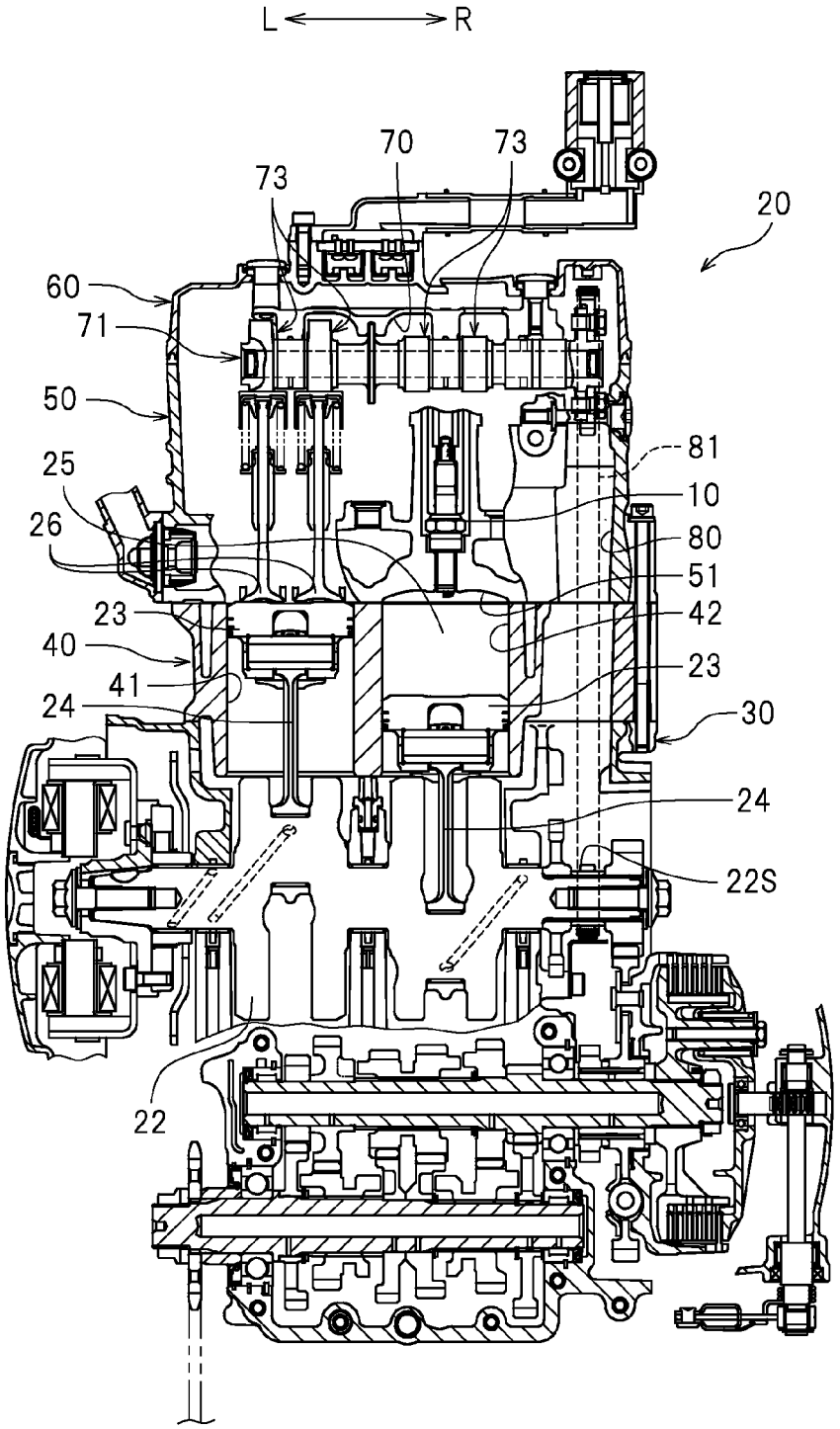
FIG. 2 is a cross-sectional view illustrating a portion of engine according to one embodiment of the present invention.

As shown in FIG. 2, the engine 20 may be provided with a crankshaft 22 that extends in the vehicle width direction. In this embodiment, the vehicle width direction refers to the vehicle lateral direction. The crankshaft 22 is disposed in the crankcase 30. A sprocket 22S may be formed at the right end of the crankshaft 22.

A first cylinder 41 and a second cylinder 42 are formed inside the cylinder body 40. The first cylinder 41 and the second cylinder 42 extend upward from the front portion of the crankcase 30. The engine 20 may be a two-cylinder engine. Pistons 23 are respectively housed in the first cylinder 41 and the second cylinder 42. Each piston 23 is connected to the crankshaft 22 through a connecting rod 24. The engine 20 according to this embodiment is a two-cylinder engine including the two cylinders 41, 42, however the engine 20 may be a single-cylinder engine having a single cylinder, or may be a multi-cylinder engine having three or more cylinders.

The engine 20 may be provided with two combustion chambers 25 disposed side by side in the vehicle width direction. The combustion chamber 25 is constituted by the top surface of the piston 23, the inner peripheral surface of each of the cylinders 41, 42, and a recess 51 formed in the cylinder head 50. An ignition device 10 for igniting the fuel inside the combustion chamber 25 is provided in the combustion chamber 25.

Figure 3:
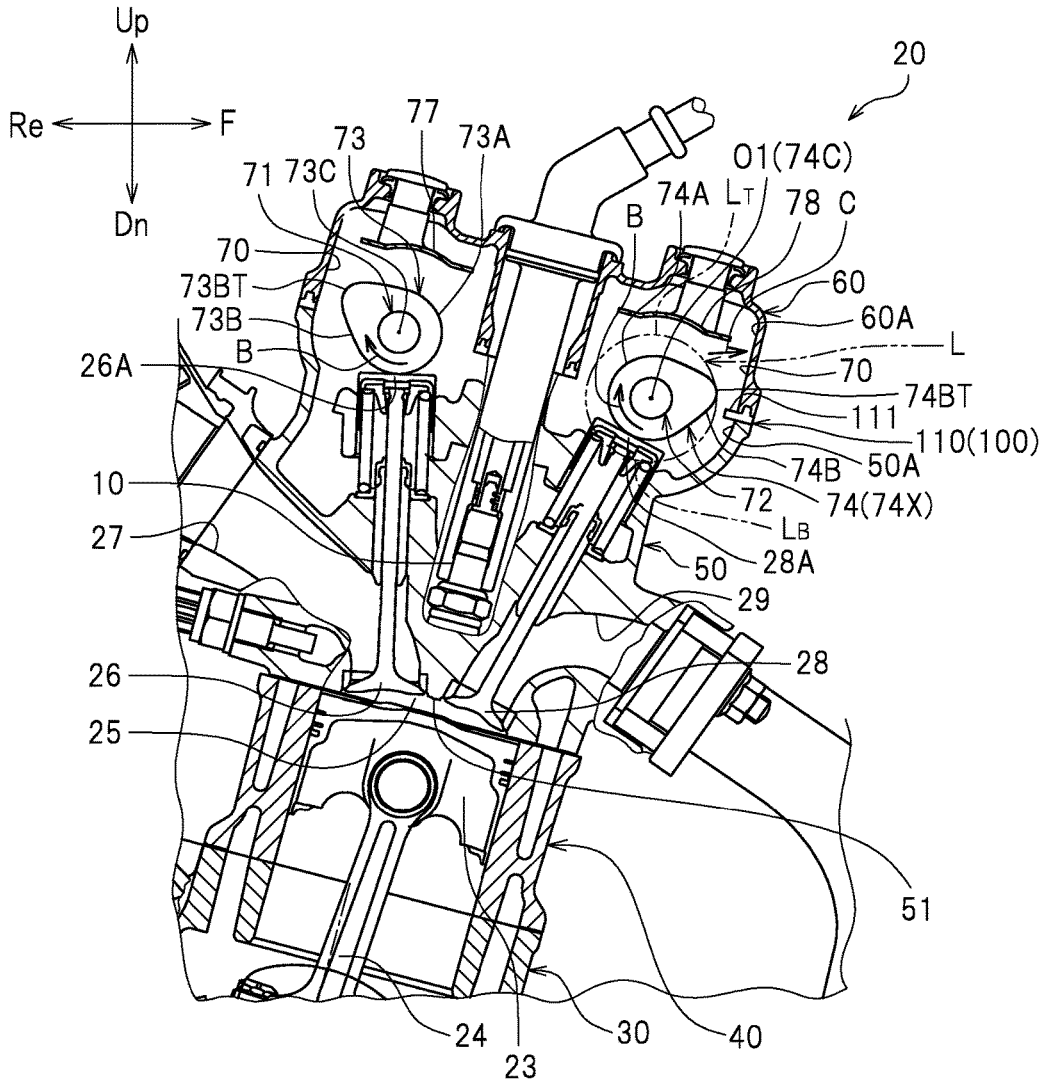
FIG. 3 is a cross-sectional view illustrating a portion of engine according to one embodiment of the present invention.

As shown in FIG. 3, the engine 20 is provided with an intake valve 26 and an exhaust valve 28. The intake valve 26 opens or closes a passage between an intake passage 27 and the combustion chamber 25. The exhaust valve 28 opens or closes a passage between the combustion chamber 25 and an exhaust passage 29.

Figure 4:
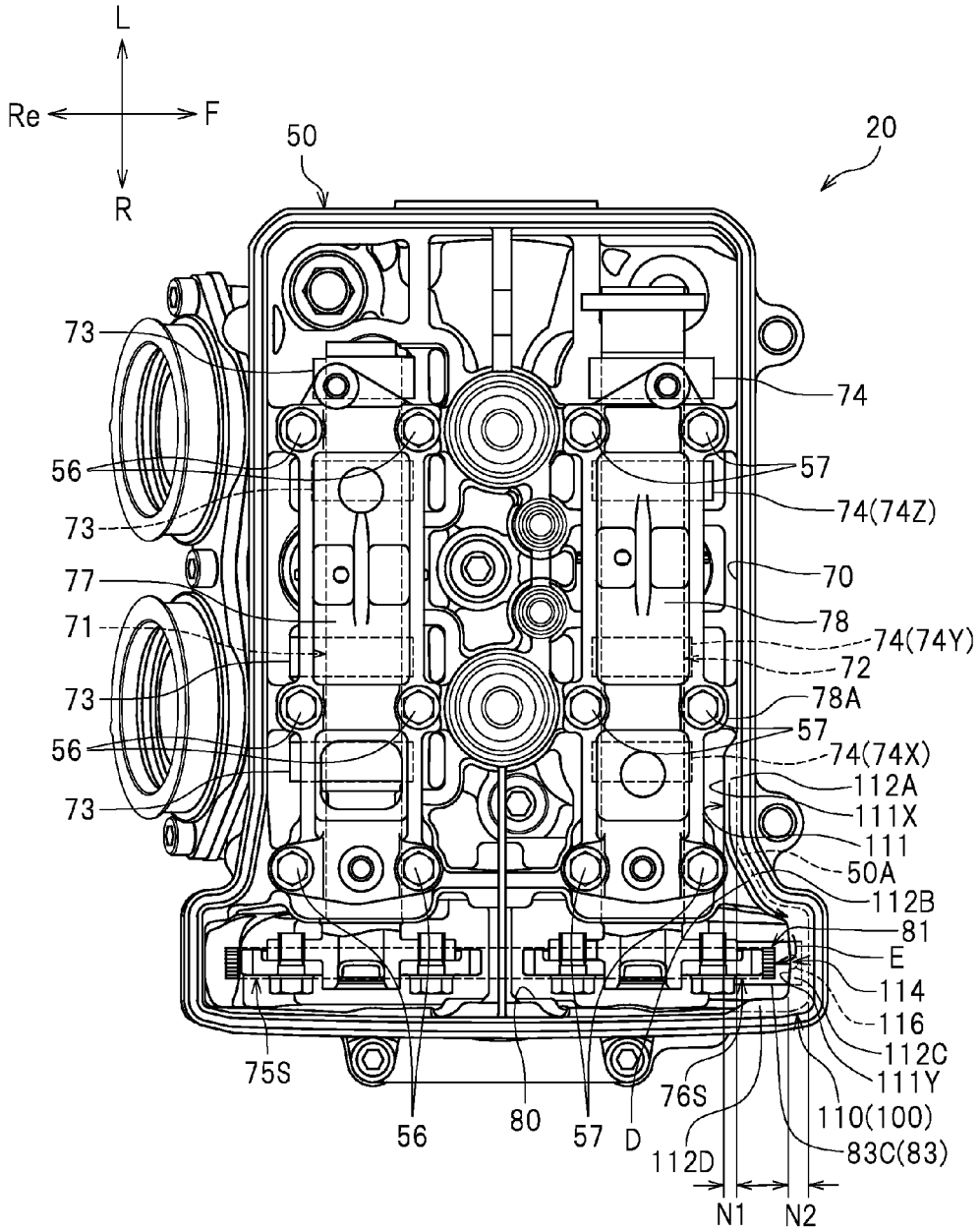
FIG. 4 is a plan view illustrating a cylinder head according to one embodiment of the present invention.
Figure 5:
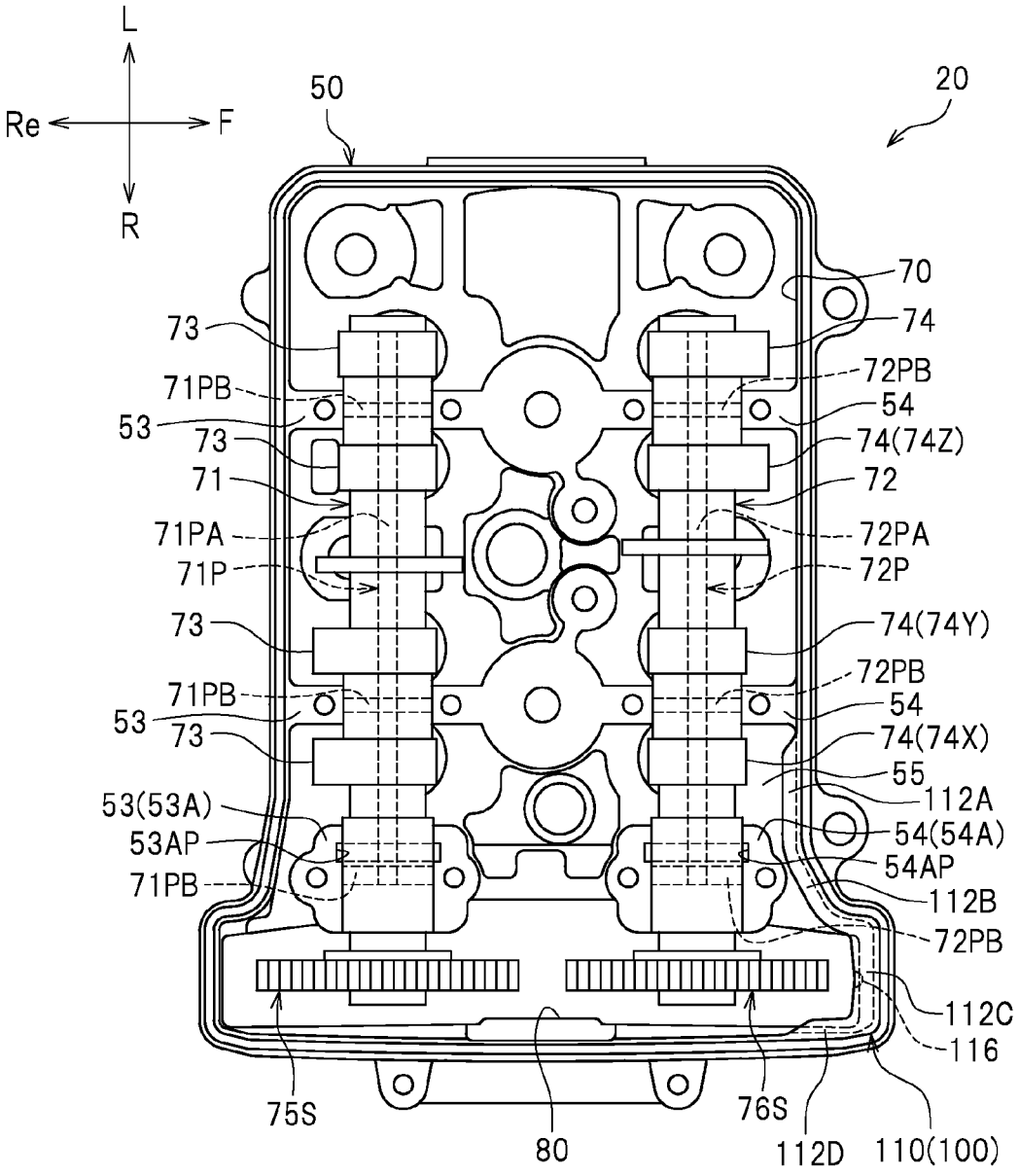
FIG. 5 is a plan view illustrating a cylinder head according to one embodiment of the present invention.

The engine 20 may be provided with a cam chamber 70. The cam chamber 70 may be formed along the cylinder head 50 and the cylinder head cover 60. As shown in FIG. 4, the engine 20 is provided with an intake camshaft 71 extending in the lateral direction and an exhaust camshaft 72 extending in the lateral direction. The intake camshaft 71 may be disposed in the cam chamber 70 and a cam chain chamber 80 that is described below. The exhaust camshaft 72 is disposed in the cam chamber 70 and the cam chain chamber 80. As shown in FIG. 5, the intake camshaft 71 is supported by a support portion 53 formed on the cylinder head 50. The exhaust camshaft 72 is supported by a support portion 54 formed on the cylinder head 50. As shown in FIG. 3, the intake camshaft 71 and the exhaust camshaft 72 are disposed between the cylinder head 50 and the cylinder head cover 60. As shown in FIG. 4, a cam chain sprocket 75S is attached to the right end of the intake camshaft 71. The cam chain sprocket 75S is disposed in a cam chain chamber 80. A cam chain sprocket 76S is attached to the right end of the exhaust camshaft 72. The cam chain sprocket 76S is disposed in a cam chain chamber 80. An after-mentioned cam chain 81 is wound around the cam chain sprockets 75S, 76S. The intake camshaft 71 and the exhaust camshaft 72 are interlocked with the cam chain 81.

Figure 6:
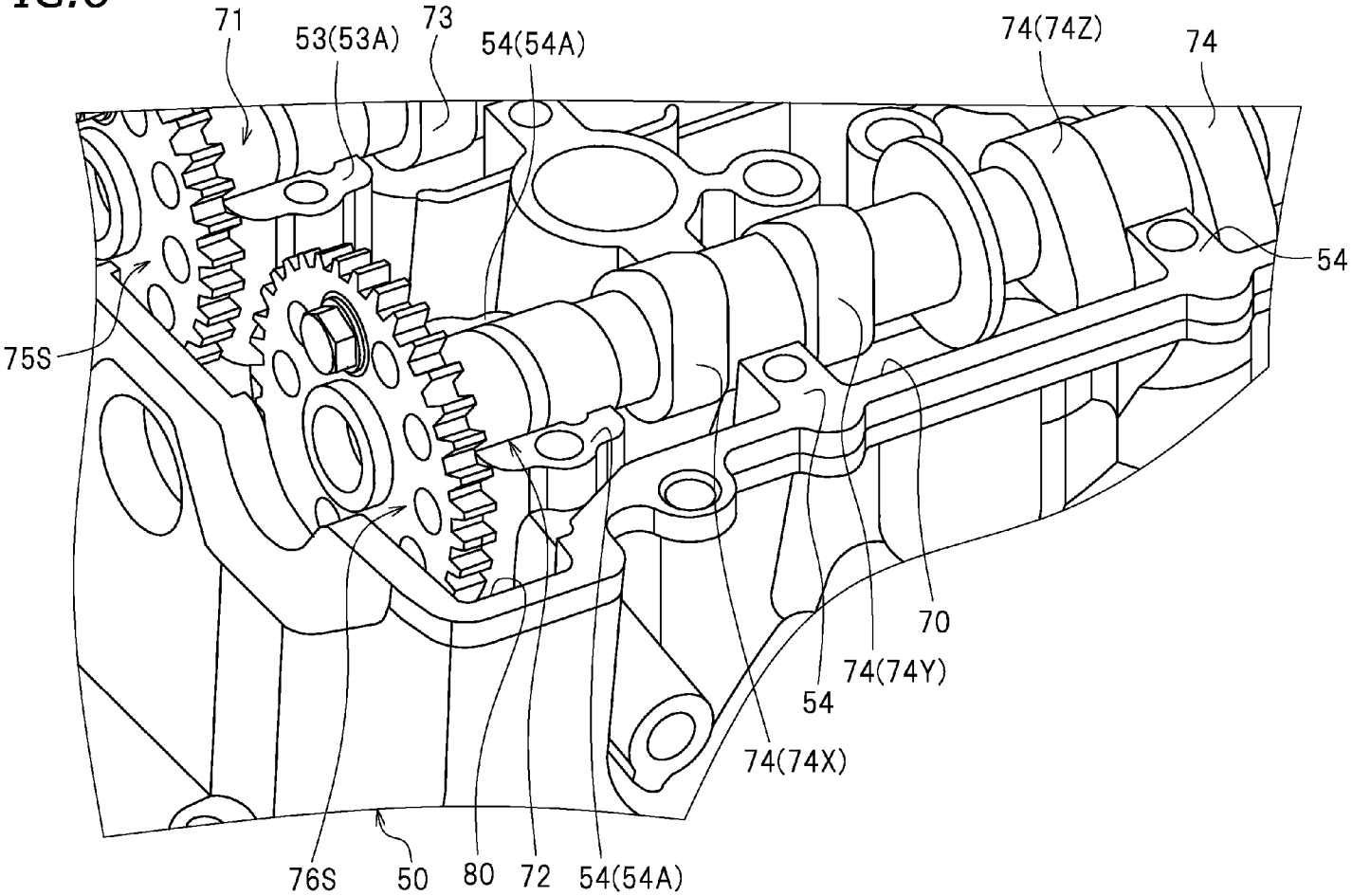
FIG. 6 is a perspective view illustrating a portion of a cylinder head according to one embodiment of the present invention.

As shown in FIG. 6, the intake camshaft 71 may be provided with a plurality of intake cams 73. The intake cams 73 are disposed in the cam chamber 70. The intake cams 73 are secured to the intake camshaft 71. The intake cam 73 rotates integrally with the intake camshaft 71. As shown in FIG. 3, the intake cam 73 may be constituted by a base portion 73A having a constant outer diameter and a lift portion 73B having a prescribed cam profile. A distance from the center 73C of the intake cam 73 to the outer periphery of the lift portion 73B is not constant. The longer the distance from the center 73C of the intake cam 73 to the tip end 73BT of the lift portion 73B, the longer the period while the intake valve 26 is opened. The intake cam 73 may be in contact with an intake lifter 26A attached to the upper end of the intake valve 26. The intake valve 26 operates associated with the rotation of the intake cam 73. Specifically, when the base portion 73A of the intake cam 73 is in contact with the intake lifter 26A, the intake valve 26 does not move. Thereby, the passage between the intake passage 27 and the combustion chamber 25 is kept closed. Whereas, the intake valve 26 moves downward when the lift portion 73B of the intake cam 73 comes in contact with the intake lifter 26A. Thereby, the passage between the intake passage 27 and the combustion chamber 25 is opened.

As shown in FIG. 6, the exhaust camshaft 72 may be provided with a plurality of exhaust cams 74. The exhaust cams 74 are disposed in the cam chamber 70. The exhaust cams 74 are secured to the exhaust camshaft 72. The exhaust cam 74 rotates integrally with the exhaust camshaft 72. As shown in FIG. 3, the exhaust cam 74 is constituted by a base portion 74A having a constant outer diameter and a lift portion 74B having a prescribed cam profile. A distance from the center 74C of the exhaust cam 74 to the outer periphery of the lift portion 74B is not constant. The longer the distance from the center 74C of the exhaust cam 74 to the tip end 74BT of the lift portion 74B, the longer the period while the exhaust valve 28 is opened. The exhaust cam 74 may be in contact with an exhaust lifter 28A attached to the upper end of the exhaust valve 28. The exhaust valve 28 operates associated with the rotation of the exhaust cam 74. Specifically, when the base portion 74A of the exhaust cam 74 is in contact with the exhaust lifter 28A, the exhaust valve 28 does not move. Thereby, the passage between the exhaust passage 29 and the combustion chamber 25 is kept closed. Whereas, the exhaust valve 28 moves downward when the lift portion 74B of the exhaust cam 74 comes in contact with the exhaust lifter 28A. Thereby, the passage between the exhaust passage 29 and the combustion chamber 25 is opened.

As shown in FIG. 3, an intake cam cap 77 may be disposed above the intake cam shaft 71 and the intake cam 73. As shown in FIG. 4, the intake cam cap 77 may overlap a portion of the intake cam shaft 71 and a portion of the intake cam 73 in a plan view. The intake cam cap 77 is attached to the cylinder head 50 with bolts 56. As shown in FIG. 3, an exhaust cam cap 78 is disposed above the exhaust cam shaft 72 and the exhaust cam 74. As shown in FIG. 4, the exhaust cam cap 78 may overlap a portion of the exhaust cam shaft 72 and a portion of the exhaust cam 74 in a plan view. The exhaust cam cap 78 is attached to the cylinder head 50 with bolts 57.

FIG. 5 is a plan view of the cylinder head 50 according to this embodiment. In FIG. 5, the intake cam cap 77 and the exhaust cam cap 78 are not illustrated. An oil passage 71P may be formed inside the intake camshaft 71. The oil passage 71P includes a main passage 71PA extending in the lateral direction of the intake camshaft 71 and a sub passage 71PB communicating with the main passage 71PA. The sub passage 71PB extends in the vehicle longitudinal direction. The sub passage 71PB may be opened toward the support portion 53 of the cylinder head 50. An oil supply passage 53AP may be formed at a support portion 53A that is closest to the cam chain chamber 80 among the support portions 53. A portion of the oil flowing through the cylinder head 50 flows in the oil passage 71P of the intake camshaft 71 through the oil supply passage 53AP. The oil flowing through the sub passage 71PB may be supplied to the support portions 53. The oil supplied to the support portions 53 flows downward from the side of the support portions 53 and lubricates a contact portion between the intake cam 73 and the intake lifter 26A.

An oil passage 72P may be formed inside the exhaust camshaft 72. The oil passage 72P includes a main passage 72PA extending in the lateral direction of the exhaust camshaft 72 and a sub passage 72PB communicating with the main passage 72PA. The sub passage 72PB extends in the vehicle longitudinal direction. The sub passage 72PB may be opened toward the support portion 54 of the cylinder head 50. An oil supply passage 54AP may be formed at a support portion 54A that is closest to the cam chain chamber 80 among the support portions 54. A portion of the oil flowing through the cylinder head 50 flows in the oil passage 72P of the exhaust camshaft 72 through the oil supply passage 54AP. The oil flowing through the sub passage 72PB is supplied to the support portions 54. The oil supplied to the support portions 54 flows downward from the side of the support portions 54 and lubricates a contact portion between the exhaust cam 74 and the exhaust lifter 28A.

Figure 11:
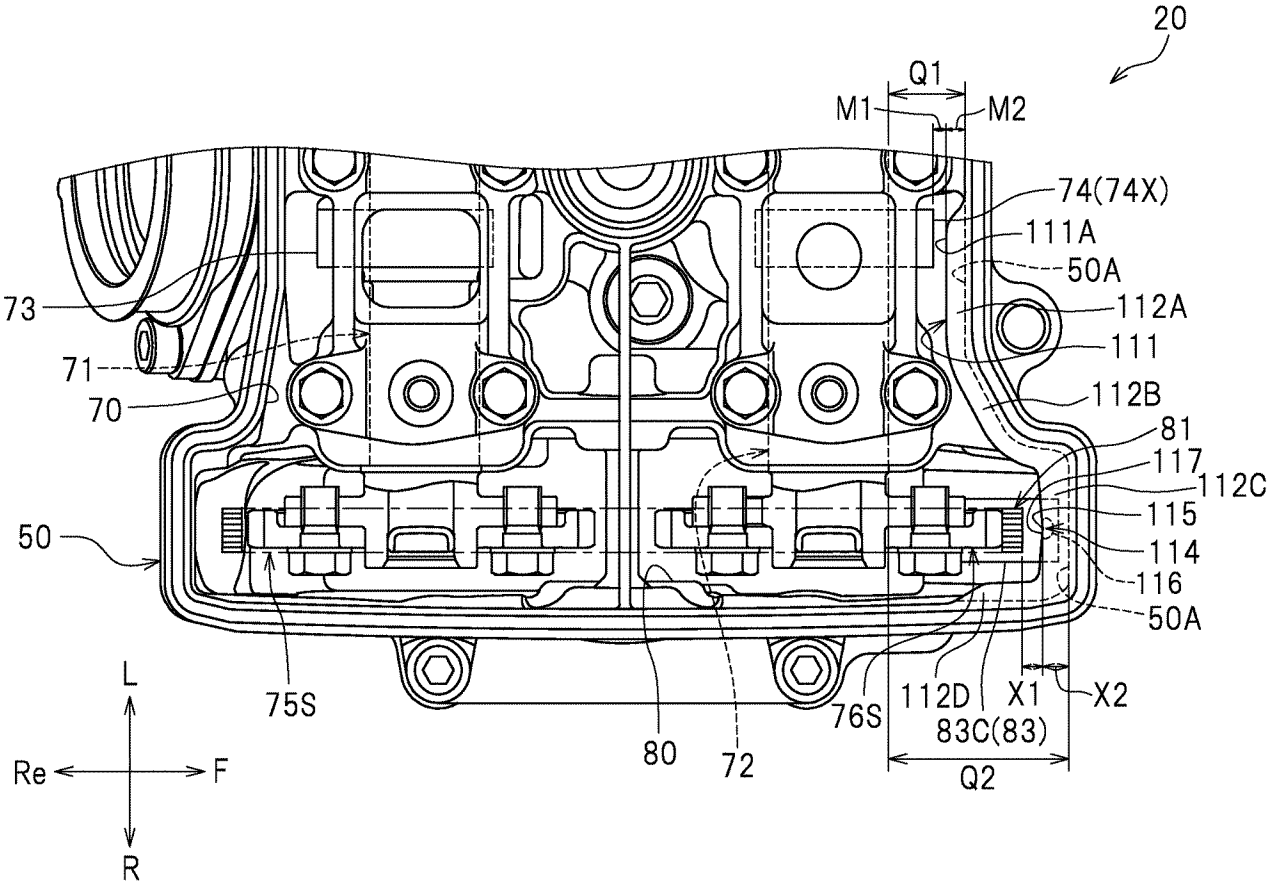
FIG. 11 is a partially enlarged plan view of a cylinder head according to one embodiment of the present invention illustrating an exhaust cam making its closest approach to the projection.

As shown in FIG. 2, the engine 20 may be provided with a cam chain chamber 80. The cam chain chamber 80 may be formed all over the cylinder head cover 60, the cylinder head 50, the cylinder body 40, and the crankcase 30. The cam chain chamber 80 may be disposed on the right side of the second cylinder 42. However, the cam chain chamber 80 may be disposed on the left side of the first cylinder 41. As shown in FIG. 4, the front end of the cam chain chamber 80 may be located frontward relative to the front end of the cam chamber 70. The rear end of the cam chain chamber 80 may be located rearward relative to the rear end of the cam chamber 70. The cam chain chamber 80 and the cam chamber 70 communicate with each other. As shown in FIG. 11, in a plan view, the distance Q1 between the exhaust camshaft 72 and the inner wall 50A of the cylinder head 50 in the cam chamber 70 may be shorter than the distance Q2 between the exhaust camshaft 72 and the inner wall 50A of the cylinder head 50 in the cam chain chamber 80.

Figure 7:
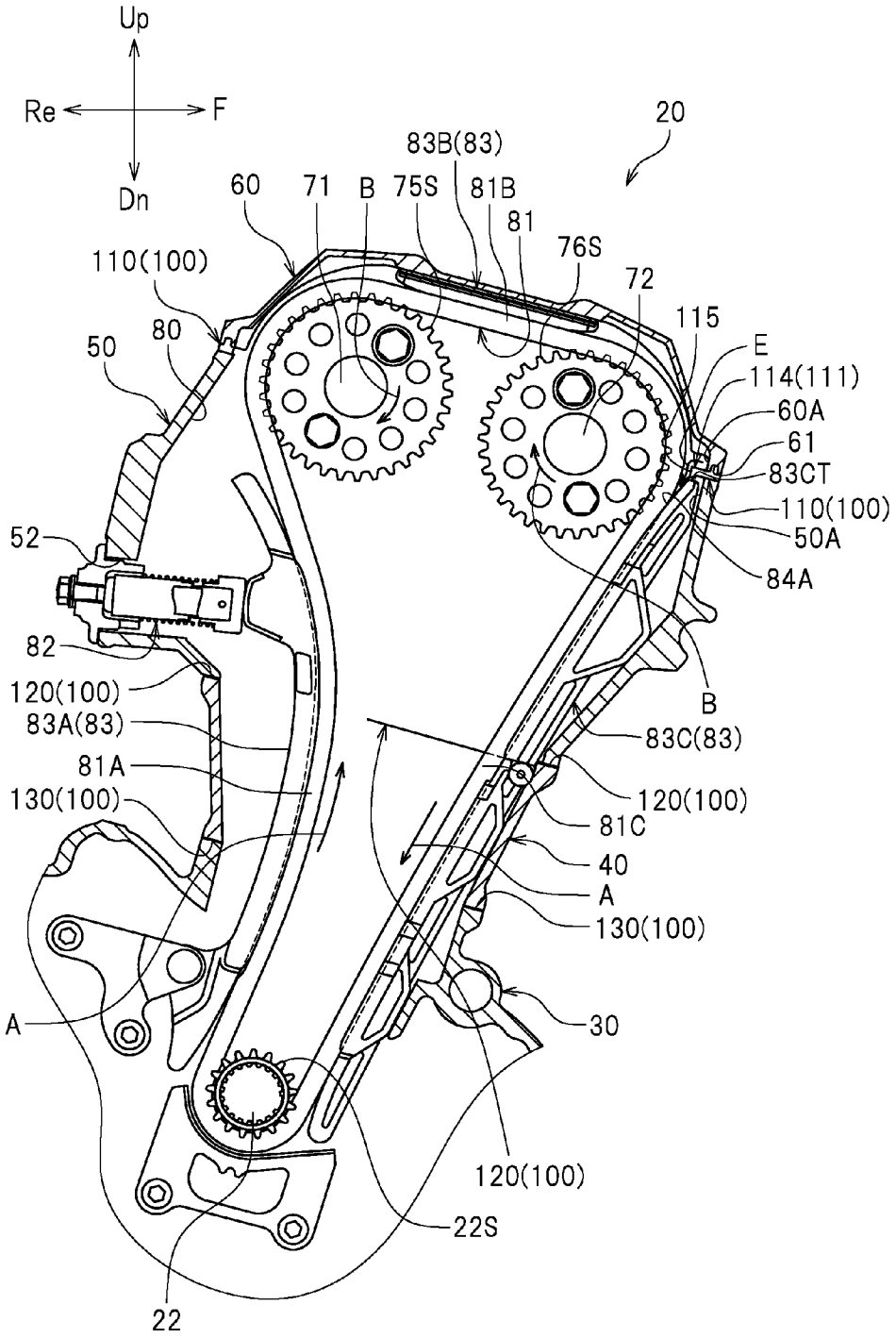
FIG. 7 is a cross-sectional view illustrating a cam chain chamber of an engine according to one embodiment of the present invention.

As shown in FIG. 7, the engine 20 may be provided with the cam chain 81, a chain tensioner 82, and a cam chain guide 83. The cam chain 81, the chain tensioner 82, and the cam chain guide 83 are disposed in the cam chain chamber 80. The cam chain 81 may be wound around the sprocket 22S, a cam chain sprocket 75S, and a cam chain sprocket 76S. The cam chain 81 may be interlocked with the crankshaft 22. The cam chain 81 may be provided with a first portion 81A, a second portion 81B and a third portion 81C. The first portion 81A may be located between the sprocket 22S and the cam chain sprocket 75S. The second portion 81B may be located between the cam chain sprocket 75S and the cam chain sprocket 76S. The third portion 81C may be located between the cam chain sprocket 76S and the sprocket 22S.

The cam chain guide 83 guides the cam chain 81. The engine 20 has a first cam chain guide 83A, a second cam chain guide 83B, and a third cam chain guide 83C as the cam chain guide 83. The first cam chain guide 83A guides the first portion 81A of the cam chain 81. The second cam chain guide 83B guides the second portion 81B of the cam chain 81. The third cam chain guide 83C guides the third portion 81C of the cam chain 81. The upper end 83CT of the third cam chain guide 83C may be spaced away from the cam chain 81. The upper end 83CT of the third cam chain guide 83C extends toward an after-mentioned first gasket 110. The upper end 83CT of the third cam chain guide 83C may be located below the first gasket 110.

The chain tensioner 82 is a member for appropriately keeping a tension applied to the cam chain 81. The chain tensioner 82 may be inserted in a chain tensioner insertion hole 52 formed in the cylinder head 50. The chain tensioner 82 is secured to the cylinder head 50 with a bolt (not shown) inserted in a bolt insertion hole (not shown) formed in the cylinder head 50. However, the chain tensioner 82 may be secured to the cylinder body 40 by forming the chain tensioner insertion hole in the cylinder body 40.

The engine 20 may be provided with a plurality of gaskets 100 to prevent oil from leaking out of the engine 20. The engine 20 has a first gasket 110, a second gasket 120, and a third gasket 130 as the gaskets 100. The first gasket 110 may be located between the cylinder head 50 and the cylinder head cover 60. The first gasket 110 seals the gap between the cylinder head 50 and the cylinder head cover 60. The second gasket 120 may be located between the cylinder body 40 and the cylinder head 50. The second gasket 120 seals the gap between the cylinder body 40 and the cylinder head 50. The third gasket 130 may be located between the crankcase 30 and the cylinder body 40. The third gasket 130 seals the gap between the crankcase 30 and the cylinder body 40.

Figure 8:
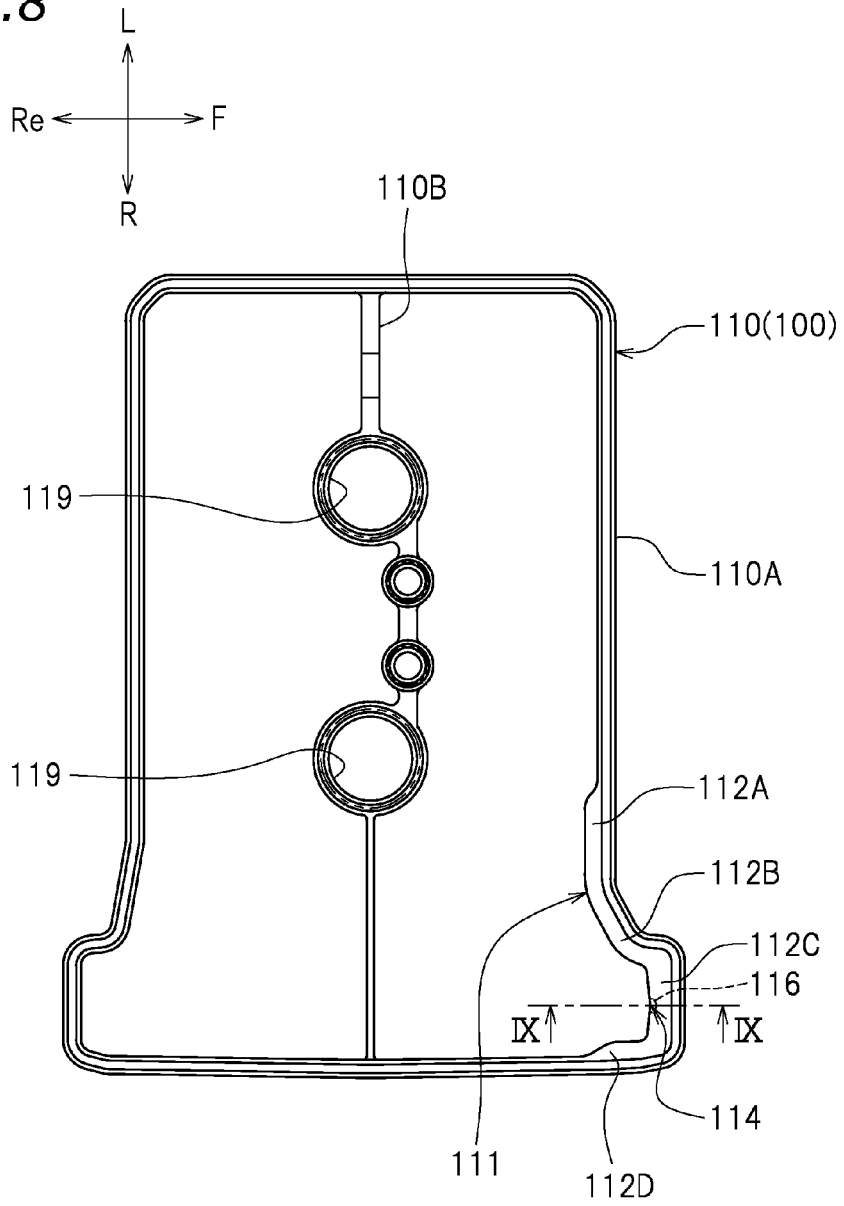
FIG. 8 is a plan view illustrating a first gasket according to one embodiment of the present invention.
Figure 9:
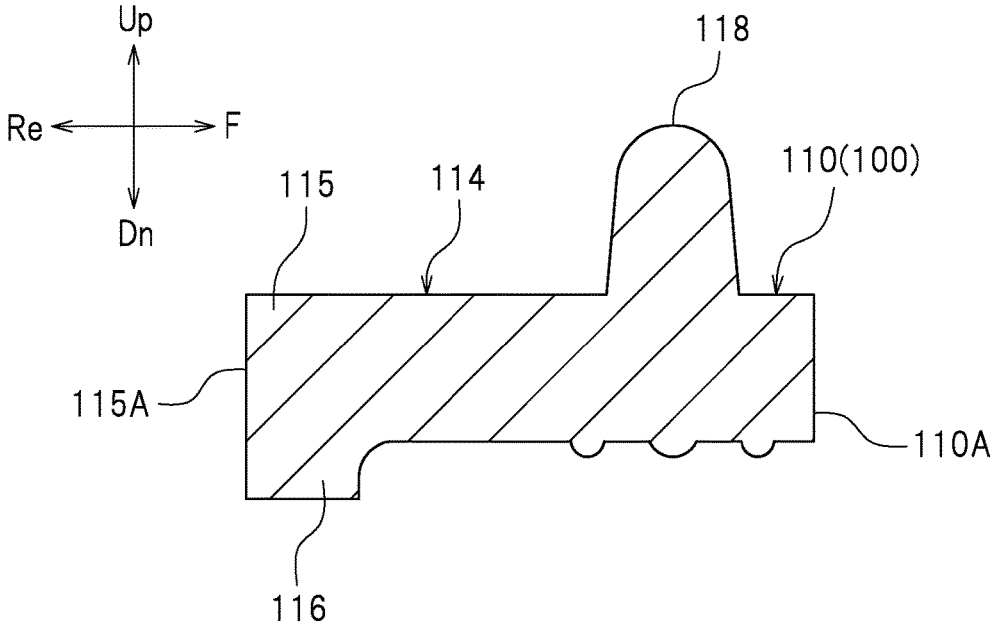
FIG. 9 is a cross-sectional view taken along line IX-IX of FIG. 8.

As shown in FIG. 8, the first gasket 110 may have a first portion 110A disposed all over the circumference of the portion where the upper surface of the cylinder head 50 (see FIG. 3) and the lower surface of the cylinder head cover 60 (see FIG. 3) face each other; and a second portion 110B located inside the first portion 110A and disposed in the cam chamber 70 and the cam chain chamber 80. As shown in FIG. 9, the first portion 110A of the first gasket 110 has a projection 118. The projection 118 may be formed all over the circumference of the first portion 110A. The projection 118 is configured such that the projection 118 can be mated with a recess 61 (see FIG. 7) formed in the cylinder head cover 60. As shown in FIG. 8, the second portion 110B of the gasket 110 has insertion holes 119 through which an ignition device 10 (see FIG. 2) is inserted.

The first gasket 110 may be provided with a projection 111 projecting from the first portion 110A toward inside the first portion 110A. As shown in FIG. 7, the projection 111 projects from the inner wall 50A of the cylinder head 50 and the inner wall 60A of the cylinder head cover 60 toward the exhaust camshaft 72. As shown in FIG. 4, the projection 111 may be disposed in the cam chamber 70 and in the cam chain chamber 80. The projection 111 may be continuously formed from the cam chamber 70 to the cam chain chamber 80. The projection 111 has a first portion 112A extending in the lateral direction, a second portion 112B extending from the right end of the first portion 112A in the diagonally forward and rightward, a third portion 112C extending rightward from the front end of the second portion 112B, and a fourth portion 112D extending backward from the rear end of the third portion 112C. The length at the left end of the first portion 112A in the front back direction gradually becomes shorter as it goes leftward. The length at the rear end of the fourth portion 112D in the lateral direction gradually becomes shorter as it goes backward. The first portion 112A may be disposed in the cam chamber 70. The second portion 112B is disposed in the cam chamber 70 and the cam chain chamber 80. The third portion 112C and the fourth portion 112D are disposed in the cam chain chamber 80. The second portion 112B, the third portion 112C, and the fourth portion 112D of the projection 111 are formed in a U shape in a plan view in the cam chain chamber 80. The third portion 112C and the third cam chain guide 83C may overlap each other in a plan view. The projection amount of the first portion 112A, the second portion 112B, the third portion 112C, and the fourth portion 112D of the projection 111 may be the same or may be different from each other. Here, the projection amount of the projection 111 refers to the length from the inner wall 50A of the cylinder head 50 and the inner wall 60A of the cylinder head cover 60 to the tip end of the projection 111. In this embodiment, the projection amount of the third portion 112C may be greater than the projection amount of the first portion 112A. The projection amount of the third portion 112C may be greater than the projection amount of the second portion 112B. The projection amount of the third portion 112C may be greater than the projection amount of the fourth portion 112D. In a plan view, the distance N1 between the tip end 111X of the projection 111 and the inner wall 50A of the cylinder head 50 in the cam chamber 70 may be shorter than the distance N2 between the tip end 111Y of the projection 111 and the inner wall 50A of the cylinder head 50 in the cam chain chamber 80.

As shown in FIG. 3, the projection 111 may be located below the upper end $L_T$ of a rotational locus L of the exhaust cam 74. The projection 111 may be located above the lower end $L_B$ of a rotational locus L of the exhaust cam 74. The projection 111 may be located below an axial center O1 of the exhaust camshaft 72. FIG. 11 is a view illustrating the exhaust cam 74 making its closest approach to the projection 111. As shown in FIG. 11, the first portion 112A of the projection 111 may be disposed at a position facing the exhaust cam 74 in a plan view. The first portion 112A of the projection 111 may be disposed at the same position as the exhaust cam 74 in the axial direction of the exhaust cam shaft 72 in a plan view. When the exhaust cam 74 makes its closest approach to the projection 111 in a plan view, the distance M1 between the exhaust cam 74 and the projection 111 may be shorter than the distance M2 between the portion 111A of the position 111 to which the exhaust cam 74 makes its closest approach and the inner wall 50A of the cylinder head 50.

The projection 111 has an oil supply portion 114. The oil supply portion 114 may be formed to supply the cam chain with the oil flowing on the upper surface of the projection 111 through the third cam chain guide 83C. The oil supply portion 114 may be disposed in the cam chain chamber 80. The oil supply portion 114 may be located frontward relative to the cam chain sprocket 76S. The oil supply portion 114 and the third cam chain guide 83C may overlap each other in a plan view. As shown in FIG. 7, the oil supply portion 114 may be located above the third cam chain guide 83C.

As shown in FIG. 9, the oil supply portion 114 may have a protrusion 116 at an end portion 115. The protrusion 116 protrudes downward. As shown in FIG. 7, the end portion 115 may be located above the third cam chain guide 83C. As shown in FIG. 11, in a plan view, the distance X1 between the cam chain 81 and the tip end 115A (see FIG. 9) of the end portion 115 of the oil supply portion 114 may be shorter than the distance X2 between the tip end 115A of the end portion 115 of the oil supply portion 114 and the inner wall 50A of cylinder head 50. The third cam chain guide 83C extends toward the inner wall 50A of cylinder head 50, and the end portion 115 and the third cam chain guide 83C may overlap each other in a plan view. Thereby, the length of the distance X2 can be shortened.

Figure 10:
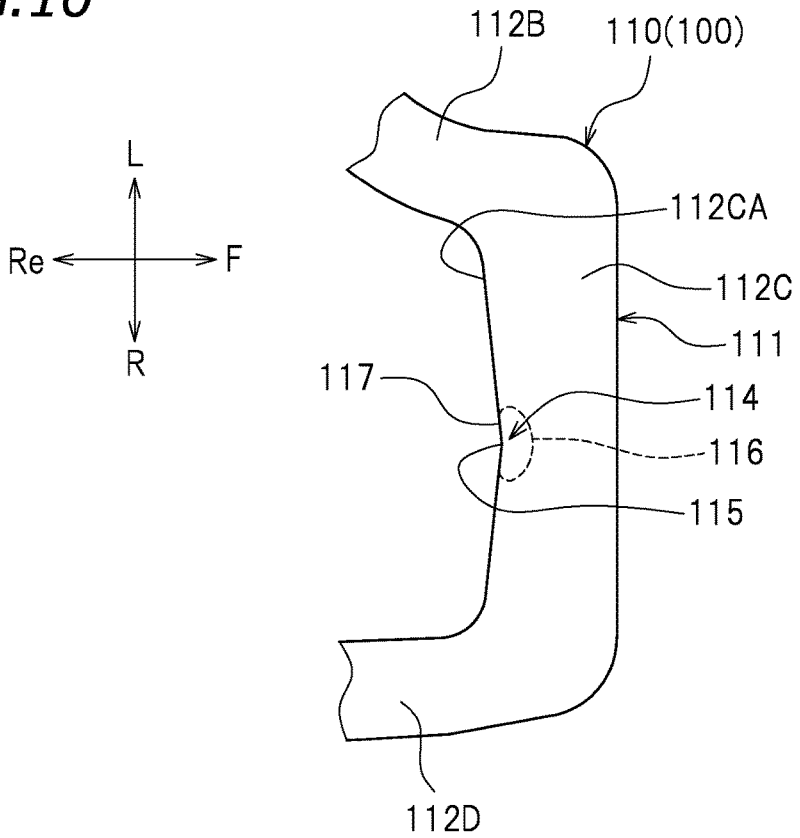
FIG. 10 is a partially enlarged view of FIG. 8.

The oil supply portion 114 may have a recess 117 recedes towards the inner wall 50A of the cylinder head 50 and the inner wall 60A (See FIG. 7) of the cylinder head cover 60. As shown in FIG. 10, the tip end 112CA of the third portion 112C of the projection 111 extends toward the recess 117 in a plan view. The projection amount of the recess 117 may be smaller than the projection amount of the portion where the second portion 112B and the third portion 112C of the projection 111 are connected to each other. The projection amount of the recess 117 may be smaller than the projection amount of the portion where the third portion 112C and the fourth portion 112D of the projection 111 are connected to each other. The recess 117 may be formed in a substantially V shape in a plan view.

As shown in FIG. 7, the cam chain 81 interlocked with the crankshaft 22 moves in the direction shown by an arrow A in FIG. 7. When the cam chain 81 moves, the intake camshaft 71 and the exhaust camshaft 77 rotate in the direction shown by an arrow B in FIG. 7. As shown in FIG. 3, the exhaust cam rotates associated with the rotation of the exhaust camshaft 72. Here, the oil lubricating the exhaust cam 74 and the exhaust lifter 28A may collect in a recess 55 (see FIG. 5) formed in front of the exhaust camshaft 72 in the cylinder head 50. As such, when the exhaust cam 74 rotates, the oil collecting in the recess 55 may be scooped up by the lift portion 73B and may be scattered. A portion of the oil scattered from the exhaust cam 74X flows in the direction as shown by an arrow C in FIG. 3 and collides with the surface of the inner wall 60A of the cylinder head cover 60. The oil which has collided with the surface of the inner wall 60A flows downward along the surface of the inner wall 60A and is collected on the upper surface of the projection 111. A portion of the oil scattered from the exhaust cam 74X is directly scattered on the upper surface of the projection 111. The oil collected on the upper surface of the projection 111 flows from the cam chamber 70 to the cam chain chamber 80 along the upper surface of the projection 111 as shown by an arrow D in FIG. 4. A portion 78A of the exhaust cam cap 78 may be located on the left side of the projection 111. Therefore, even if the oil collected on the upper surface of the projection 111 would flow in the direction opposite the direction toward the cam chain chamber 80 (the direction opposite the direction shown by the arrow D in FIG. 4), the exhaust cam cap 78 suppresses the flow. In this embodiment, a portion of the bolt 57 for securing the exhaust cam cap 78 to the cylinder head 50 may be disposed between the exhaust cam 74X and the exhaust cam 74Y. However, the portion of the bolt 57 may be disposed between the exhaust cam 74Y and the exhaust cam 74Z. In this case, the oil scattered from the exhaust cam 74Y also flows on the upper surface of the projection 111.

The oil that flows into the cam chain chamber 80 flows to the oil supply portion 114. The oil that flows into the oil supply portion 114 may be supplied to the third cam chain guide 83C located below the oil supply portion 114 along the protrusion 116 (see FIG. 9) of the oil supply portion 114 as shown by an arrow E in FIG. 4. The oil supplied to the third cam chain guide 83C flows on the contact surface 84A between the third cam chain guide 83C and the cam chain 81 as shown in an arrow E in FIG. 7. In this way, the oil scattering from the exhaust cam 74X is supplied to the cam chain 81. Additionally, the projection 111 can collect the oil scattering from the cam chain 81 on the upper surface of the projection 111. As such, even the oil scattering form the cam chain 81 may be supplied to the cam chain 81.

As shown in FIG. 7, the cylinder head 50 may be tilted diagonally upward and forward as shown in FIG. 7. As such, the inner wall 50A of the cylinder head 50 is tilted forward. The projection 111 is tilted such that as it goes backward, it goes upward. Thereby, the oil scattering from the exhaust cam 74X hardly drops downward from the projection 111 when flowing on the upper surface of the projection 111 from the cam chamber 70 to the cam chain chamber 80. As a result, the oil scattering from the exhaust cam 74X can be effectively collected in the oil supply portion 114. Additionally, when the cylinder head 50 extends upward without being tilted, the projection 111 is horizontally disposed. Also in this case, the oil scattering from the exhaust cam 74X caused by the vibration of the engine 20 and so forth flows on the upper surface of the projection 111 from the cam chamber 70 to the cam chain chamber 80 and is collected in the oil supply portion 114.

Figure 12:
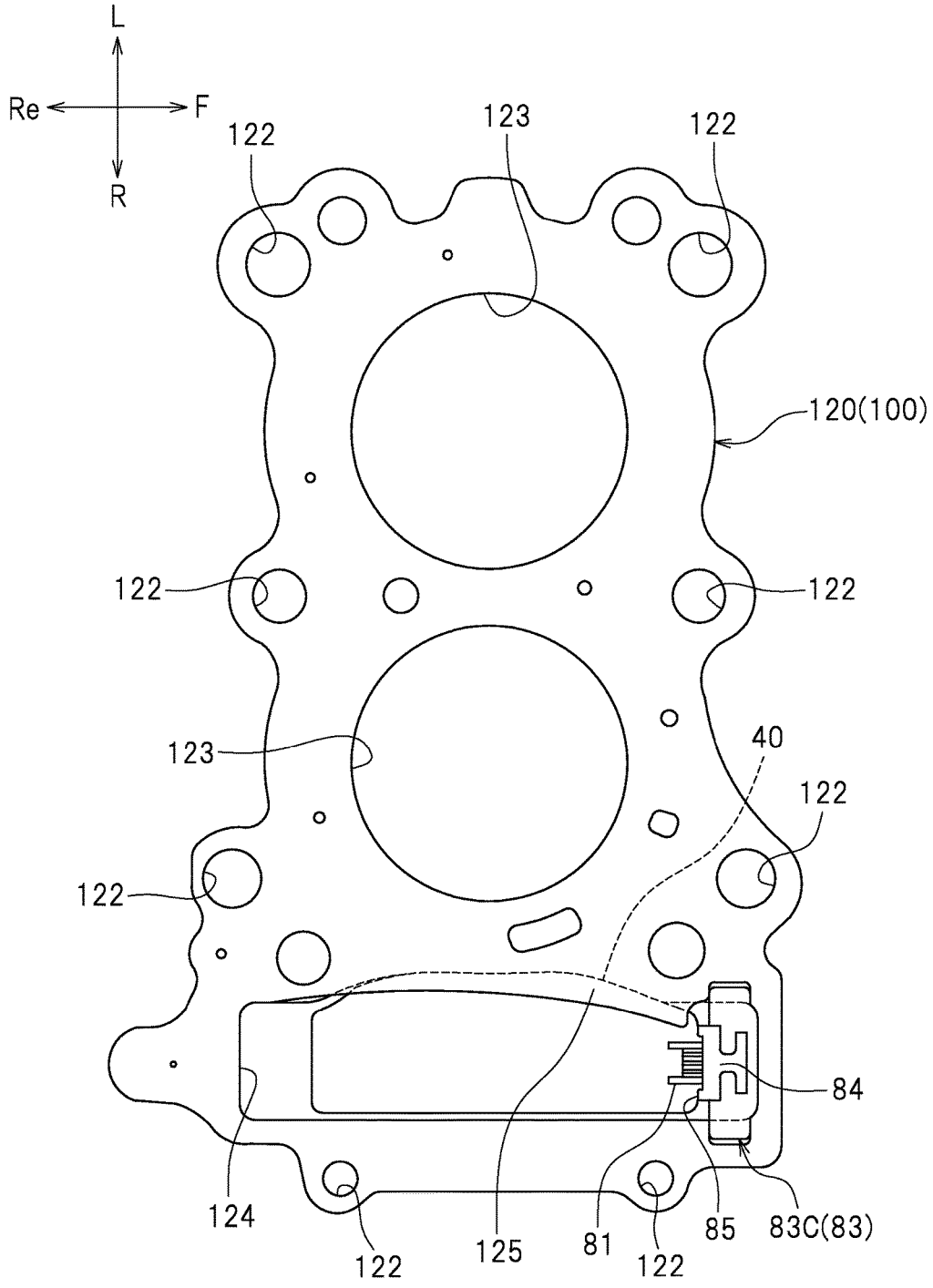
FIG. 12 is a plan view illustrating a second gasket according to one embodiment of the present invention.

As shown above, the second gasket 120 may be located between the cylinder body 40 and the cylinder head 50. FIG. 12 is a plan view illustrating the second gasket 120 disposed on the upper surface of the cylinder body 40. As shown in FIG. 12, the second gasket 120 has a plurality of bolt insertion holes 122 into which bolts are inserted when connecting the cylinder body 40 and the cylinder head 50 with the bolts. Cylinder holes 123 are respectively formed in the second gasket 120 at the positions corresponding to the first cylinder 41 (see FIG. 2) and the second cylinder 42 (see FIG. 2). A cam chain chamber hole 124 may be formed in the second gasket 120 at the position corresponding to the cam chain chamber 80. The second gasket 120 has an extension portion 125 extending toward the cam chain chamber hole 124. The extension portion 125 and the cylinder body 40 do not overlap each other in a plan view. The extension portion 125 may be formed such that the closer to the third cam chain guide 83C, the closer to the cam chain 81.

Figure 13:
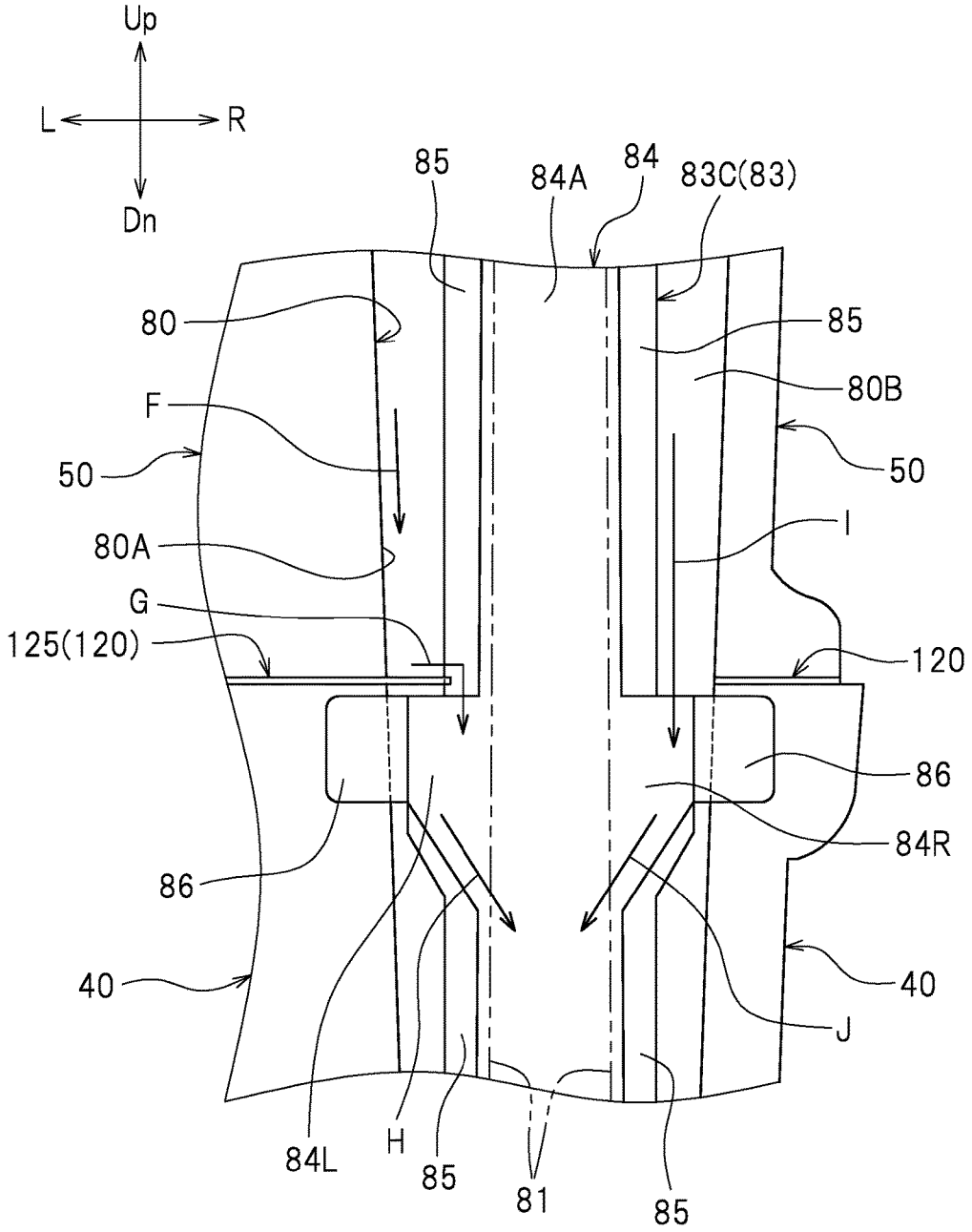
FIG. 13 is a front view illustrating a portion of a third cam chain guide according to one embodiment of the present invention.
Figure 14:
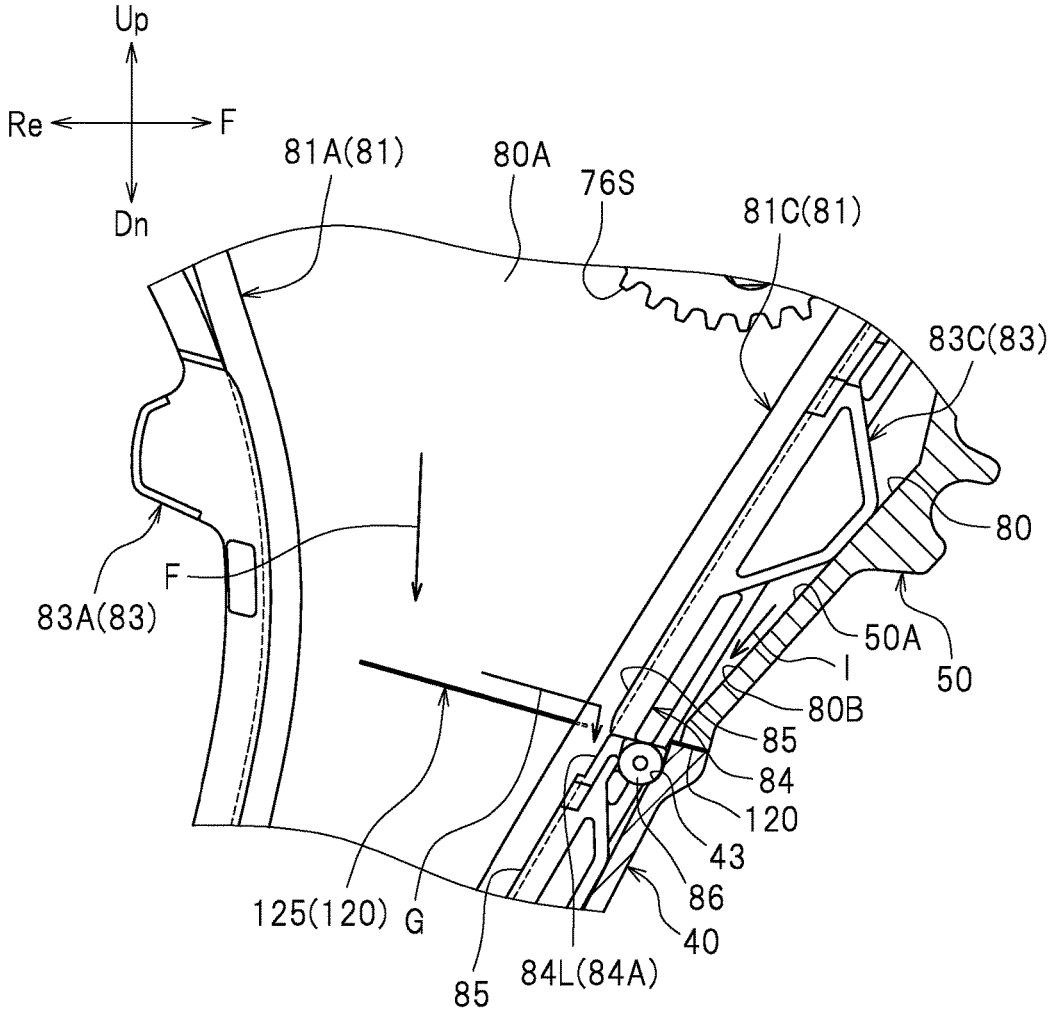
FIG. 14 is a partially enlarged view of FIG. 7.

As shown in FIG. 13, the third cam chain guide 83C may be provided with a base portion 84 having a contact surface 84A brought into contact with the cam chain 81, a wall 85 for restricting the lateral movement of the cam chain 81, and a fixing portion 86. The wall 85 projects in a direction away from the contact surface 84A. As such, a difference in level exists between the wall 85 and the contact surface 84A. The base portion 84 has a left surface 84L formed on the left side of the contact surface 84A and a right surface 84R formed on the right side of the contact surface 84A. The contact surface 84A, the left surface 84L, and the right surface 84R are formed on the same plane. The left surface 84L and the right surface 84R are not in contact with the cam chain 81. The left surface 84L and the right surface 84R are located below the second gasket 120. The fixing portion 86 is located on the left side of the left surface 84L and on the right side of the right surface 84R. As shown in FIG. 14, the fixing portion 86 may be disposed in a level difference portion 43 of the cylinder body 40 so that the third cam chain guide 83C may be fixed to the cylinder body 40.

The extension portion 125 may project from the side wall 80A of the cam chain chamber 80. As such, a portion of the oil circulating inside the cam chain chamber 80 flows in the direction shown by arrow F in FIG. 14 along the side wall 80A of the cam chain chamber 80, and flows on the extension portion 125 of the second gasket 120. The extension portion 125 extends to the upper side of the left surface 84L. As such, the oil flowing on the extension portion 125 flows in the direction shown by an arrow G in FIG. 14 and supplied to the third cam chain guide 83C. Specifically, the oil flowing on the extension portion 125 flows on the left surface 84L of the third cam chain guide 83C. The oil flowing on the left surface 84L collide with the wall 85 located below the left surface 84L and supplied to the contact surface 84A as shown by an arrow H in FIG. 13. The contact surface 84A and the cam chain 81 are in contact with each other, and thus oil is supplied to the cam chain 81. Further, as shown in FIG. 14, a portion of the oil circulating inside the cam chain chamber flows in the direction shown by an arrow I in FIG. 14 along the front wall 80B of the cam chain chamber 80 and flows on the right surface 84R (see FIG. 13) of the first cam chain guide 83C. The oil flowing on the right surface 84R collide with the wall 85 located below the right surface 84R as shown by an arrow J in FIG. 13, and supplied to the contact surface 84A. The contact surface 84A and the cam chain 81 are in contact with each other, and thus oil is supplied to the cam chain 81.

As described above, in the engine 20 according to this embodiment, the first gasket 110 may be provided with the projection 111 projecting from the inner wall 50A of the cylinder head 50 and the inner wall 60A of the cylinder head cover 60 toward the exhaust camshaft 72 as shown in FIG. 3. The projection 111 may be located in the cam chain chamber 80 and the cam chamber 70 as shown in FIG. 4. As such, a portion of the oil scattering from the exhaust cam 74 associated with the rotation of the exhaust cam 74 collides with the inner wall 60A of the cylinder head cover 60 and collected on the projection 111 located in the cam chamber 70 along the inner wall 60A. The projection 111 may be located in the cam chain chamber 80 and the cam chamber 70, and thus the oil in the cam chamber 70 collected on the projection 111 flows from the cam chamber 70 to the cam chain chamber 80 on the projection 111. The projection 111 has the oil supply portion 114 which may be disposed in the cam chain chamber 80 and located above the third cam chain guide 83C. As such, the oil flowing on the projection 111 from the cam chamber 70 to the cam chain chamber 80 may be supplied from the oil supply portion 114 to the contact surface 84A between the third cam chain guide 83C and the cam chain 81. The third cam chain guide 83C may be in contact with the cam chain 81 on the contact surface 84A. As such, the oil supplied to the third cam chain guide 83C may be supposed to be supplied to the cam chain 81. If it were not for the projection 111 as in a conventional engine, the oil scattering from the exhaust cam 74 would flow downward along the inner wall 60A and collected in an oil pan 35. As such, to supply the cam chain 81 with much more oil, the oil circulating inside the engine needs to be increased. However, according to this embodiment, the oil scattering from the exhaust cam 74 in the cam chamber 70 can be supplied to the cam chain 81, and thus a sufficient amount of oil can be supplied to the cam chain 81 without increasing the amount of the oil circulating in the engine 20.

According to this embodiment, the oil supply portion 114 may be formed to supply the cam chain 81 with the oil flowing on the upper surface of the projection 111 through the third cam chain guide 83C. Thereby, the oil flowing on the upper surface of the projection 111 from the cam chamber 70 to the cam chain chamber 80 may be supplied from the oil supply portion 114 to the cam chain 81 through the third cam chain guide 83C.

According to this embodiment, as shown in FIG. 11, the oil supply portion 114 may overlap the third cam chain guide 83C in a plan view. Thereby, oil can be more reliably supplied from the oil supply portion 114 to the third cam chain guide 83C.

According to this embodiment, as shown in FIG. 11, the oil flowing on the projection 111 from the cam chamber 70 to the cam chain chamber 80 may be guided to the recess 117. When comparing a case where there is the recess 117 with a case where there isn't, if there is the recess 117, oil tends to collect in a single portion even more. As such, the oil scattering from the exhaust cam 74 in the cam chamber 70 can be effectively collected to the oil supply portion 114. As a result, the oil collected in the cam chamber 70 can be supplied from the oil supply portion 114 to the cam chain 81 through the third cam chain guide 83C.

According to this embodiment, as shown in FIG. 9, the oil supply portion 114 may have a protrusion 116 protruding downward. When there is the protrusion 116, the oil flowing from the oil supply portion 114 tends to concentrate on the protrusion 116. As such, the oil scattering from the exhaust cam 74 in the cam chamber 70 can be effectively guided to the third cam chain guide 83C with the protrusion 116 disposed above the third cam chain guide 83C.

According to this embodiment, as shown in FIG. 11, the projection amount of the end portion 115 of the oil supply portion 114 is relatively large. As such, the oil collected in the cam chamber 70 and the oil scattering from the cam chain 81 flow on the projection 111 even more. As a result, a lot more oil can be supplied to the third cam chain guide 83C.

According to this embodiment, as shown in FIG. 4, the projection 111 may be continuously formed from the cam chamber 70 to the cam chain chamber 80. Thereby, the oil scattering from the exhaust cam 74 can be guided more effectively from the cam chamber 70 to the cam chain chamber 80.

According to this embodiment, as shown in FIG. 11, the projection amount of the first portion 112A and the projection amount of the second portion 112B of the projection 111 may be smaller than the projection amount of the third portion 112C of the projection 111. As such, the first portion 112A and the second portion 112B may be compactly disposed. Further, although the projection 111 is bent at the connection portion between the second portion 112B and the third portion 112C, the projection amount of the third portion 112C is relatively large, and thus, when the oil flows from the second portion 112B to the third portion 112C, the oil hardly drops downward. Also, the distance between the oil supply portion 114 and the cam chain 81 becomes shorter, and thus the cam chain 81 can be easily supplied with oil.

According to this embodiment, as shown in FIG. 3, the projection 111 may be located below the upper end $L_T$ of a rotational locus L of the exhaust cam 74. Thereby, the oil scattering from the exhaust cam 74 may be collected on the projection 111 even more. As a result, the oil flowing on the projection 111 from the cam chamber 70 to the cam chain chamber 80 increases even more, and the amount of oil supplied to the cam chain 81 also increases.

According to this embodiment, as shown in FIG. 4, the first portion 112A of the projection 111 may be disposed at a position facing the exhaust cam 74. Even if the first portion 112A of the projection 111 is not disposed at a position facing the exhaust cam 74, the oil scattering from the exhaust cam 74 is collected on the projection 111. However, according to this embodiment, the oil scattering from the exhaust cam 74 is even more collected on the projection 111. As a result, the oil flowing on the projection 111 from the cam chamber 70 to the cam chain chamber 80 further increases, and thus the amount of oil supplied to the cam chain 81 also increases.

According to this embodiment, as shown in FIG. 11, the projection amount of the first portion 112A of the projection 111 is relatively large. As such, the oil scattering from the exhaust cam 74 in the cam chamber 70 can be even more collected on the first portion 112A of the projection 111. As a result, the oil flowing on the projection 111 from the cam chamber 70 to the cam chain chamber 80 further increases, and thus the amount of oil supplied to the cam chain 81 also increases.

According to this embodiment, as shown in FIG. 5, the oil passing through the sub passage 72PB of the oil passage 72P formed in the exhaust camshaft 72 and lubricating the contact portion between the lifter 28A (see FIG. 3) and the exhaust cam 74X tends to collect in the recess 55 of the cylinder head 50. The oil collecting in the recess 55 is scooped up by the exhaust cam 74X and flows on the projection 111. In this way, the oil lubricating the contact portion between the lifter 28A and the exhaust cam 74X may be effectively used as oil for lubricating the cam chain 81.

According to this embodiment, as shown in FIG. 4, the projection 111 may be formed in a U shape in a plan view in the cam chain chamber 80. As such, the projection 111 hardly moves in the vertical direction of a vehicle and can maintain a stable condition. That is, even if the first gasket 110 is provided with the projection 111, the sealing performance between the cylinder head 50 and the cylinder head cover 60 is maintained. Further, the oil scattering from the cam chain 81 in the can chain chamber 80 can be collected on the projection 111.

According to this embodiment, the inner wall 50A of the cylinder head 50 may be tilted forward. As such, the oil attached to the inner wall 50A of the cylinder head 50 hardly drops downward. Further, the projection 111 is tilted further downward as it goes forward, and thus the oil flowing on the projection 111 hardly drops downward. Thereby, the oil flowing on the projection 111 may be supplied to the cam chain guide 83C more reliably through the oil supply portion 114.

In this embodiment, the first gasket 110 has the projection 111 in front of the exhaust camshaft 72, but is not limited thereto. For example, the first gasket 110 may have a projection behind the exhaust camshaft 72. In this case, the oil scattering from the exhaust cam 73 flows on the projection and is supplied to the first portion 81A of the cam chain 81.

In this embodiment, the oil supply portion 114 has the protrusion 116 at the end portion 115, but is not limited thereto. For example, a cutout may be provided at the end portion 115 of the oil supply portion 114 or a recess receded downward may be provided at the end portion 115 of the oil supply portion 114.

The terms and expressions used herein are used for explanation purposes and should not be construed as being restrictive. It should be appreciated that the terms and expressions used herein do not eliminate any equivalents of features illustrated and mentioned herein, and allow various modifications falling within the claimed scope of the present invention. The present invention may be embodied in many different forms. The present disclosure is to be considered as providing examples of the principles of the present invention. These examples are described herein with the understanding that such examples are not intended to limit the present invention to preferred embodiments described herein and/or illustrated herein. Hence, the present invention is not limited to the preferred embodiments described herein. The present invention includes any and all preferred embodiments including equivalent elements, modifications, omissions, combinations, adaptations and/or alterations as would be appreciated by those skilled in the art on the basis of the present disclosure. The limitations in the claims are to be interpreted broadly based on the language included in the claims and not limited to examples described in the present specification or during the prosecution of the application.

The invention claimed is:

1. An engine, comprising:

a crankcase;

a cylinder body extending upward from the crankcase;

a cylinder head coupled to an upper portion of the cylinder body;

a cylinder head cover coupled to an upper portion of the cylinder head;

a cam chain chamber formed in the engine along the cylinder body, the cylinder head, and the cylinder head cover;

a cam chain guide disposed in the cam chain chamber;

a cam chamber formed in the engine along the cylinder head and the cylinder head cover;

a crankshaft disposed in the crankcase;

a cam chain disposed in the cam chain chamber, and configured to interlock with the crankshaft and be guided by the cam chain guide;

a camshaft disposed in the cam chamber and configured to interlock with the cam chain;

a cam formed on the camshaft and disposed in the cam chamber; and a gasket disposed between the cylinder head and the cylinder head cover, the gasket including a projection formed thereon that projects along a direction from an inner wall of the cylinder head toward the camshaft, and a direction from an inner wall of the cylinder head cover toward the camshaft, is located in the cam chain chamber and the cam chamber, and has an oil supply portion disposed in the cam chain chamber and above the cam chain guide.

2. The engine according to claim 1, wherein the oil supply portion is configured to supply oil flowing on an upper surface of the projection through the cam chain guide to the cam chain.

3. The engine according to claim 1, wherein the oil supply portion overlaps the cam chain guide in a plan view of the engine.

4. The engine according to claim 3, wherein the oil supply portion includes a recess that recedes towards the inner wall of the cylinder head and the inner wall of the cylinder head cover in the plan view of the engine.

5. The engine according to claim 3, wherein the oil supply portion includes a protrusion protruding downward.

6. The engine according to claim 1, wherein a distance between the cam chain and an end of the oil supply portion is shorter than a distance between the end of the oil supply portion and the inner wall of the cylinder head in a plan view of the engine.

7. The engine according to claim 1, wherein the projection is continuously formed from the cam chamber to the cam chain chamber.

8. The engine according to claim 7, wherein a distance between the camshaft and the inner wall of the cylinder head in the cam chamber is shorter than a distance between the camshaft and the inner wall of the cylinder head in the cam chain chamber in a plan view of the engine, and a distance between a tip end of the projection and the inner wall of the cylinder head in the cam chamber is shorter than a distance between another tip end of the projection and the inner wall of the cylinder head in the cam chain chamber in the plan view of the engine.

9. The engine according to claim 1, wherein the projection is located lower than an upper end of a rotational locus of the cam.

10. The engine according to claim 1, wherein the projection is disposed in a position where a portion of the projection faces the cam in a plan view of the engine.

11. The engine according to claim 10, wherein when the cam makes its closest approach to the projection in a plan view of the engine, a distance between the cam and the projection is shorter than a distance between a portion of the projection to which the cam makes its closest approach and the inner wall of the cylinder head.

12. The engine according to claim 1, further comprising:

a support portion configured to support the cam shaft;

a valve configured to open and close a combustion chamber; and a lifter disposed on a lateral side and a lower side of the support portion, the lifter being secured to the valve, and being in contact with the cam, wherein the camshaft includes an oil passage through which oil flows to lubricate a contact portion between the lifter and the cam, and the oil is scooped up by the cam and flows to the projection.

13. The engine according to claim 1, wherein the projection is formed in a U shape in a plan view of the engine in the cam chain chamber.

14. A straddle-type vehicle, comprising the engine according to claim 1.

15. A straddle-type vehicle according to claim 14, wherein the cylinder head is tilted diagonally upward and forward, and the projection is located in front of the camshaft, and is tilted gradually upward as the projection is tilted backward.

* * * * *